US010172412B2

(12) United States Patent
Pride

(10) Patent No.: US 10,172,412 B2
(45) Date of Patent: Jan. 8, 2019

(54) CUSHIONING SHOE INSERT

(71) Applicant: Carlene Pride, Seattle, WA (US)

(72) Inventor: Carlene Pride, Seattle, WA (US)

( * ) Notice: Subject to any disclaimer, the term of this patent is extended or adjusted under 35 U.S.C. 154(b) by 174 days.

(21) Appl. No.: 13/897,696

(22) Filed: May 20, 2013

(65) Prior Publication Data

US 2014/0338221 A1 Nov. 20, 2014

(51) Int. Cl.

| | |
|---|---|
| ***A43B 23/00*** | (2006.01) |
| ***A43B 5/12*** | (2006.01) |
| ***A43B 13/22*** | (2006.01) |
| ***A43B 7/14*** | (2006.01) |
| ***A43B 17/18*** | (2006.01) |
| ***A43B 19/00*** | (2006.01) |
| ***A43B 13/38*** | (2006.01) |
| ***A43B 17/02*** | (2006.01) |

(52) U.S. Cl.

CPC ..... *A43B 7/141* (2013.01); *A43B 7/145* (2013.01); *A43B 7/1445* (2013.01); *A43B 7/1465* (2013.01); *A43B 13/383* (2013.01); *A43B 17/02* (2013.01); *A43B 17/18* (2013.01); *A43B 19/00* (2013.01)

(58) Field of Classification Search

CPC ..... A43B 5/0407; A43B 7/145; A43B 7/1425; A43B 7/141; A43B 7/1465; A43B 7/1445; A43B 17/18; A43B 19/00; A61F 13/0289

USPC ..... 36/8.3, 43–44, 72 R, 71, 59 B, 94, 96, 36/70 R, 95; 602/43, 57–59, 42; 604/42, 604/43

See application file for complete search history.

(56) References Cited

U.S. PATENT DOCUMENTS

| | | | | |
|---|---|---|---|---|
| 326,728 | A | 9/1885 | Georges | |
| 1,637,285 | A | 7/1927 | Sheehan | |
| 2,823,673 | A * | 2/1958 | Schladermundt et al. | 602/57 |
| 4,249,319 | A | 2/1981 | Yoshida | |
| 4,250,886 | A * | 2/1981 | Riso | A43B 7/14 36/180 |
| 4,353,173 | A | 10/1982 | Paquet | |
| 5,154,682 | A | 10/1992 | Kellerman | |
| 5,373,650 | A | 12/1994 | Danaberg | |
| 5,577,302 | A | 11/1996 | Bortle | |
| 5,740,618 | A * | 4/1998 | Minden | 36/8.3 |
| 5,840,052 | A * | 11/1998 | Johns | A61F 13/023 602/54 |
| 5,998,694 | A * | 12/1999 | Jensen et al. | 602/57 |
| 6,393,734 | B1 | 5/2002 | Ou | |
| 6,810,603 | B1 | 11/2004 | Cosentino | |
| 7,232,590 | B2 | 6/2007 | Leonard | |

(Continued)

OTHER PUBLICATIONS

Extended European Search Report dated Dec. 20, 2016 for European Patent Application No. 14801553.0, 8 pages.

(Continued)

*Primary Examiner* — Timothy K Trieu
(74) *Attorney, Agent, or Firm* — Lee & Hayes, PLLC

(57) ABSTRACT

This application discloses shoe inserts which are configured such that a user may expose one or more adhesive layers while the cushioning shoe insert is maintained at an optimal location within a shoe, thereby securing the cushioning shoe inserts precisely at the optimal location. Moreover, this application discloses shoe inserts which are designed to distribute necessary support forces, e.g. through a foot chock, thereby mitigating or eliminating uncomfortable levels of localized pressure.

11 Claims, 7 Drawing Sheets

(56) References Cited

U.S. PATENT DOCUMENTS

| | | | | |
|---|---|---|---|---|
| 7,568,299 | B2 * | 8/2009 | Denha | 36/71 |
| 7,780,634 | B2 * | 8/2010 | Propp | A61M 25/02 602/41 |
| 7,827,707 | B2 | 11/2010 | Davis | |
| 7,854,075 | B2 | 12/2010 | Kosmas | |
| 8,256,142 | B2 | 9/2012 | Igdari | |
| 2007/0107261 | A1 | 5/2007 | Cheskin | |
| 2007/0209237 | A1 | 9/2007 | Denha | |
| 2009/0260263 | A1 * | 10/2009 | Beard | A43B 7/22 36/72 R |
| 2010/0146816 | A1 | 6/2010 | Cappaert | |
| 2011/0265348 | A1 | 11/2011 | Schmutte | |
| 2012/0227291 | A1 | 9/2012 | Rosenbaum | |
| 2012/0304493 | A1 | 12/2012 | Hudson | |
| 2013/0274667 | A1 * | 10/2013 | Conrad-Vlasak | A61F 13/00 604/117 |

OTHER PUBLICATIONS

European Office Action dated Apr. 18, 2018 for European patent application No. 14801553.0,. a counterpart foreign application of US patent application No. , 4 pages.

* cited by examiner

CUSHIONING SHOE INSERT

FIELD OF THE DISCLOSURE

The present disclosure relates generally to the field of shoe inserts and methods of use thereof. More particularly, the present disclosure relates to a cushioning shoe insert configured such that a user may expose one or more adhesive layers while the cushioning shoe insert is maintained at an optimal location within a shoe, thereby securing the cushioning shoe inserts precisely at the optimal location. The cushioning shoe inserts are also designed to distribute necessary support forces, thereby mitigating or eliminating uncomfortable levels of localized pressure.

BACKGROUND

This section provides background information related to the present disclosure which is not necessarily prior art.

There is an ever growing need for cushioning shoe inserts, and methods of use and optimal placement thereof, which provide greater comfort to shoe wearers. The women's fashion shoe industry, for example, often weighs aesthetic factors more heavily than factors regarding comfort when designing shoes. Rather often, the result is women's fashion shoes which are quite uncomfortable and unsuitable for long durations of use. This problem is exacerbated in shoes having either a sharply pointed toe-region, a high heel causing a steep slope, or both because these features, although quite popular, tend to increase the pressure exerted on the toes or feet. Therefore, reducing the level of uncomfortable pressure experienced by shoe wearers is of great importance, and resultantly, several types of shoe inserts with various features attempt to mitigate or eliminate this issue.

U.S. Pat. No. 7,827,707 B2 to Davis, dated Nov. 9, 2010, and fully incorporated by reference herein, discloses shoe inserts designed to provide enhanced comfort to shoe wearers. The Davis patent describes shoe inserts which are to be located within the toe region of a shoe and wherein the insert comprises a proximal toe-engaging face that is positioned to be compressed by at least some of the toes of the wearer. Moreover, the Davis patent discloses that the shoe insert is preferably formed of heat sensitive, viscoelastic, closed-cell polyuthethane memory foam material.

Whereas some shoe inserts rely on compressive forces of the shoe wearer's toes to maintain the shoe insert at an optimal location, e.g. the inner distal portion of a pointed shoe normally unoccupied by the shoe wearer's toes, some other shoe inserts are designed such that maintaining the shoe insert in an optimal location requires various attachment means, such as adhesive strips. For example, U.S. Pat. Appl. Pub. No. 2009/0260263 A1 filed by Beard, published on Oct. 22, 2009, and fully incorporated by reference herein, discloses a toe cover having a foam member, two fabric members, an adhesive strip and a nonstick cover wherein the adhesive strip secures the toes cover to a shoe. Moreover, a nonstick cover covers the adhesive strip to protect it and to prevent unintended bonding of the toe cover. The nonstick cover is removed and the toe cover is then inserted into a shoe and adhered to a surface of the shoe.

While inserting a shoe insert (or toe cover) into a shoe with an adhesive layer exposed, i.e. with any nonstick cover previously covering the adhesive already removed thereby exposing the adhesive, the user inserting the shoe insert must exercise caution not to inadvertently contact an inner surface of the shoe while the shoe insert is not at an optimal location within the shoe. Otherwise, the adhesive layer may adhere the shoe insert to an inner surface of the shoe at a less than optimal location, therefore requiring the user to remove and reattempt to adhere the shoe insert at an optimal location. Thus, a shoe insert which is capable of being inserted into, adjusted within, and even worn with a user's foot, prior to exposing any adhesive layer is desirable.

The inclusion of steep slopes within shoe designs, as previously mentioned, exacerbates the problem of uncomfortable levels of pressure being exerted on the toes or feet of shoe wearers. As a general matter, the more steeply inclined the shoe the more the plantar region of the shoe wearer's foot tends to slide down the slope thereby pushing into the distal region of the shoe. This typically results in yet another cause of increased pressure experienced by the shoe wearer because the entirety of all forces necessary to support the shoe wearer's body weight are localized in a relatively small area. Thus, shoe inserts designed to apply forces to various predetermined optimal regions of the user's foot, e.g. the metatarsal head region of a shoe wearer's foot, such that the necessary forces can be spread out to a sufficient area to decrease pressures are desirable.

The various attempts at providing greater comfort to shoe wearers, through either shoe inserts or methods of use thereof, suffer from any or all of: being quite difficult to adhere to an actual optimal location within a shoe, e.g. various shoe inserts require any nonstick cover to be removed prior to placement within an optimal location; and failing to adequately disperse necessary support forces over an adequate area such that a shoe wearer does not experience uncomfortable levels of pressure in localized regions of the toes or feet, e.g. allowing for the slope of a shoe to cause the user's foot to slide down and forward into a front region of a shoe resulting in high exerted pressures.

Accordingly, this application discloses shoe inserts which are configured such that a user may expose one or more adhesive layers while the cushioning shoe insert is maintained at an optimal location within a shoe, thereby securing the cushioning shoe inserts precisely at the optimal location. Moreover, this application discloses shoe inserts which are designed to distribute necessary support forces, e.g. through a foot chock, thereby mitigating or eliminating uncomfortable levels of localized pressure.

SUMMARY

This section provides a general summary of the disclosure, and it is not a comprehensive disclosure of its full scope or all of its features. The following embodiments and descriptions are for illustrative purposes only and are not intended to limit the scope of the cushioning shoe insert. Other aspects and advantages of the present invention will become apparent from the following detailed description.

This application discloses shoe inserts which are configured such that a user may expose one or more adhesive layers while the cushioning shoe insert is maintained at an optimal location within a shoe, thereby securing the cushioning shoe inserts precisely at the optimal location. It is an intended purpose of the cushioning shoe insert, due to the importance of optimally placing any cushioning shoe insert within an inner portion of a shoe, to enable a user to insert the cushioning shoe insert into an inner portion of a shoe while the layers of adhesive are each covered by a flexible nonstick cover. A user is then able to actually insert a foot into the cushioning shoe insert such that at least a portion of the user's foot or toes comes into contact with the inner surface of the pad. At this point the user may adjust both their foot and the cushioning shoe insert until the cushioning shoe insert is located at an optimal location, e.g. a location where the maximum cushioning of the user's foot is achieved. Finally, and while maintaining the cushioning shoe insert at the desired optimal location, the user grasps and pulls upon one or more tab(s) in order to peel off any flexible nonstick covers thereby exposing the layers of adhesive. An advantage of this capability over existing shoe inserts wherein adhesive layers are exposed prior to insertion into a shoe is that such shoe inserts tend to immediately adhere to the first surface on which contact is made and, generally, the location which such shoe inserts are initially adhered are less than optimal for maximizing comfort.

Moreover, this application discloses shoe inserts which are designed to distribute necessary support forces, e.g. through a foot chock, thereby mitigating or eliminating uncomfortable levels of localized pressure. In a preferred embodiment, the shoe insert includes a foot chock located just forward of the metatarsal heads of the foot such that support is provided directly to the metatarsal heads thereby reducing the pressure on the toe region of the foot. Due to the already discussed problem of a shoe wearer's toes often being jammed into the inner portion of a shoe, it is easily recognizable that the foot chock, by supporting the foot at a location more proximal to the body than the toes, will reduce the pressure and discomfort experienced by a shoe wearer.

BRIEF DESCRIPTION OF THE DRAWINGS

These and other features, aspects, and advantages of the present disclosure will become better understood with regard to the following description, appended claims, and accompanying drawings. The drawings described herein are for illustrative purposes only of selected embodiments, i.e. not all possible implementations, and are not intended to limit the scope of the present disclosure.

DETAILED DESCRIPTION

Figure 1:
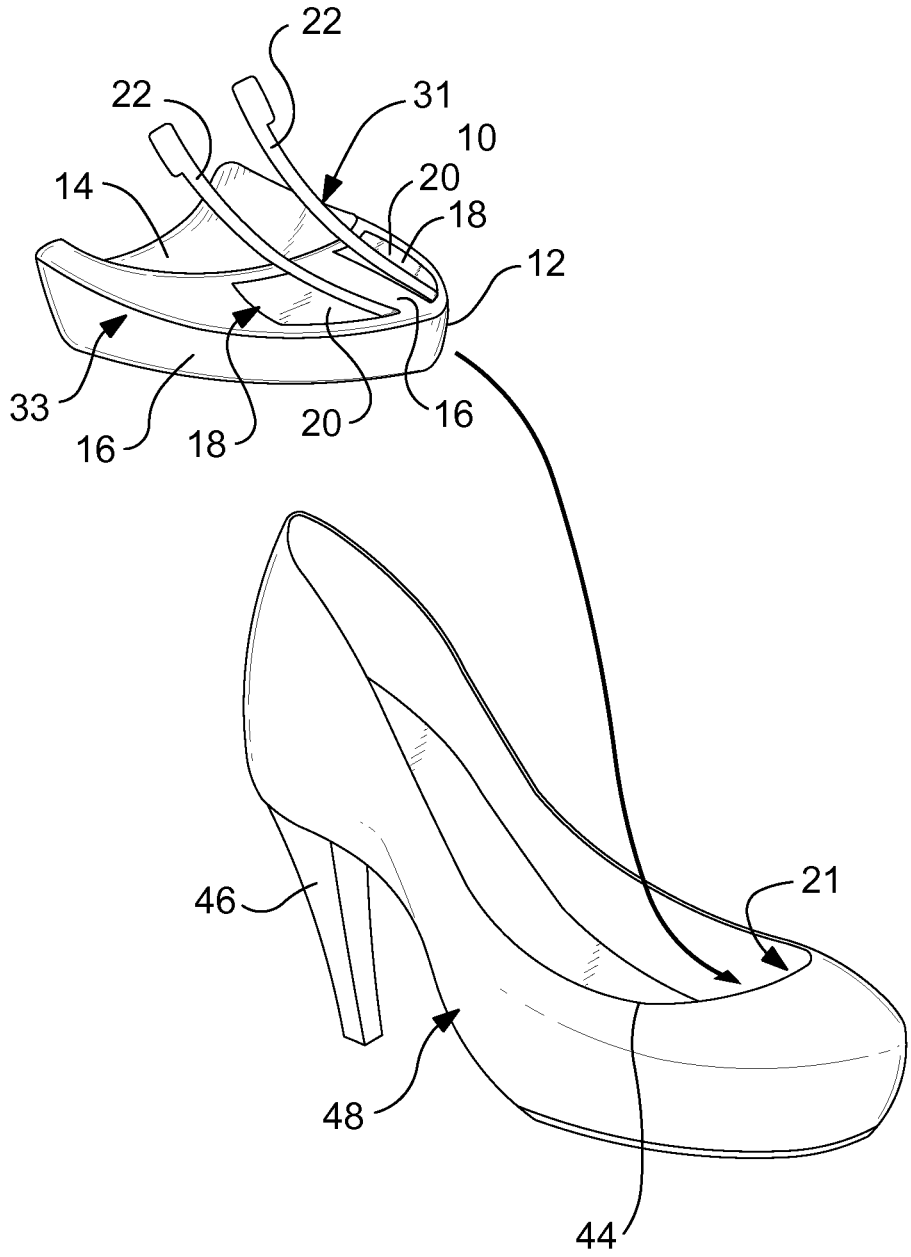
FIG. 1 illustrates a perspective view of a cushioning shoe insert prior to insertion into a shoe, in accordance with a first embodiment of the present disclosure.

Following is a description by way of example only and with reference to the accompanying drawings of a manner of constructing and using the cushioning shoe inserts. Example embodiments are provided to fully convey the scope of this disclosure to those skilled in the art. The present disclosure may have additional embodiments, may be practiced without one or more of the details described for any particular described embodiment, or may have any detail described for one particular embodiment practiced with any other detail described for another embodiment. Numerous specific details are set forth as examples and are intended to provide a thorough understanding of embodiments of the present disclosure. It will apparent to one skilled in the art that these specific details need not be employed, that example embodiments may be embodied in many different forms, and that neither should be construed to limit the scope of the disclosure. In some example embodiments, well-known processes, well-known device structures, and well-known technologies are not described in detail.

Referring now to the drawings, FIGS. 1-5 illustrate various views of a cushioning shoe insert 10 in accordance with a first embodiment of the present disclosure. The cushioning shoe insert 10 includes a pad 12 having an inner surface 14 and an outer surface 16. The cushioning shoe insert 10 may include one or more layers of adhesive 18 disposed over at least a portion of the outer surface 16 wherein the adhesive layers 18 are each covered by a flexible nonstick cover 20 having a tab 22 attached thereto. In some embodiments, there may be a single tab 22 attached to one or more flexible nonstick covers 20 whereas in other embodiments there may be one tab 22 for each flexible nonstick cover 20. The tab(s) 22 is (are) configured to protrude from an inner portion of a shoe 21 such that a user may pull upon the tab(s) 22 thereby exposing the layers of adhesive 18 while the cushioning shoe insert, and more particularly the pad 12, is maintained at an optimal location. The pad 12 may be made of low-resilience polyurethane, heat sensitive viscoelastic closed-cell polyurethane, any other type of foam or memory foam, gel, or any another suitable material for use as a cushioning shoe insert. Preferably, the pad 12 is memory foam. The pad may further comprise one or more antimicrobial agents and one or more absorbent layers such as, for example, nonwoven fabric. If such an absorbent layer is included in any particular embodiment, it is preferably adhered to the inner surface 14 of the pad 12 as a lining element for increased comfort.

Figure 2:
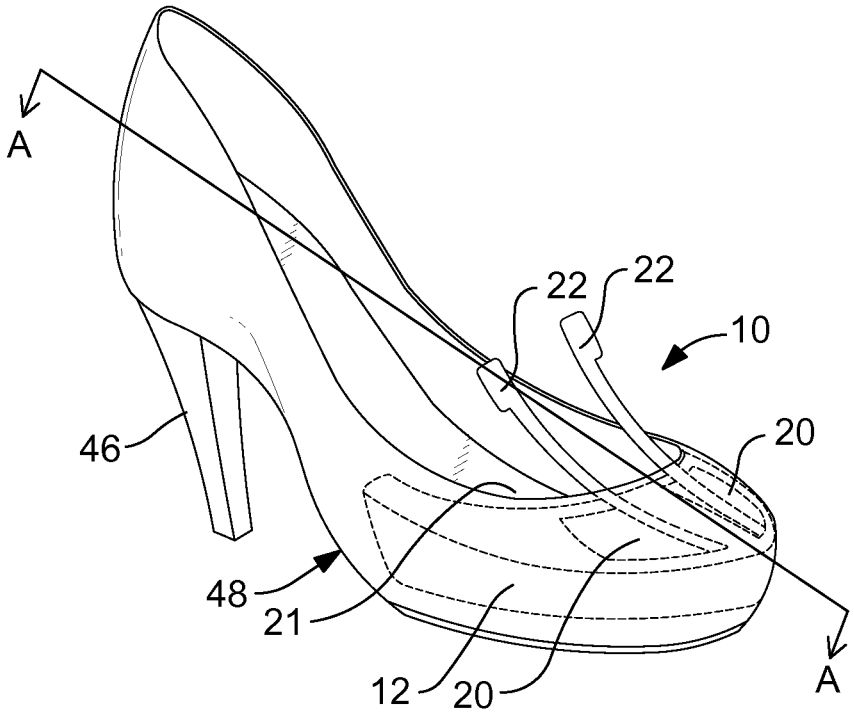
FIG. 2 illustrates a perspective view of the cushioning shoe insert, in accordance with the first embodiment, wherein the cushioning shoe insert is inserted into a shoe.
Figure 3:
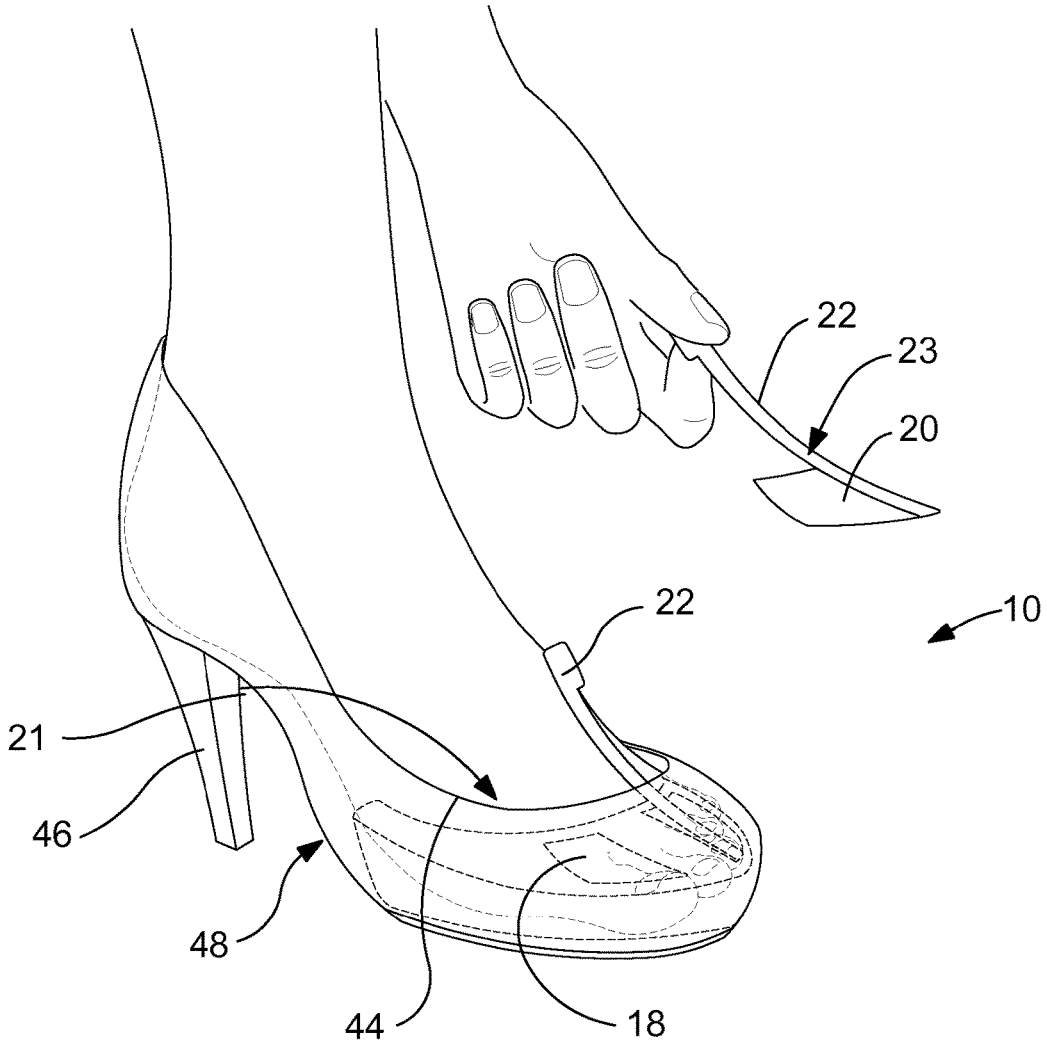
FIG. 3 illustrates a perspective view of the cushioning shoe insert, in accordance with the first embodiment, wherein a shoe wearer's foot is inserted into the cushioning shoe insert within a shoe.

As can be seen in FIGS. 2-5, it is an intended purpose of the shoe insert disclosed herein to enable a user to insert the shoe insert into a shoe prior to exposing the layers of adhesive 18. Enabling a user to insert the shoe insert 10 into a shoe prior to exposing the layers of adhesive 18 quite clearly will enable the user to insert and remove the shoe insert 10 any number of times without compromising the integrity or adhesive capabilities of the layers of adhesive 18. Thus, a user is empowered with the ability to place the shoe insert 10 into an inner portion of a shoe 21 along with one of the user's feet in order to determine what, if any, customization of the shoe insert 10 will be needed. For example, a user may wear the shoe insert 10 as she normally would with the exception of the layers of adhesive 18 being non-exposed, and then adjust the shoe insert 10 until it is in an optimal location, and then mark one or more portions of the shoe insert 10, e.g. the pad 12, for trimming, and subsequently remove the shoe insert 10 from the inner portion of the shoe 21 and trim the pad 12. Continuing with this example, the user may then re-insert the shoe insert 10 into the shoe, with the layers of adhesive remaining non-exposed (i.e. covered by the flexible nonstick covers 20), re-adjust the shoe insert 10 into an optimal location, and finally pull upon each tab 22 thereby peeling off the flexible nonstick cover 20 from the layers of adhesive 18. FIG. 3 illustrates the first embodiment of the shoe insert 10 after the user has removed one of two flexible nonstick covers 20 exposing the layer of adhesive 18 which thus adheres the shoe insert 10 to the inner portion 21 of the depicted shoe.

Figure 4:
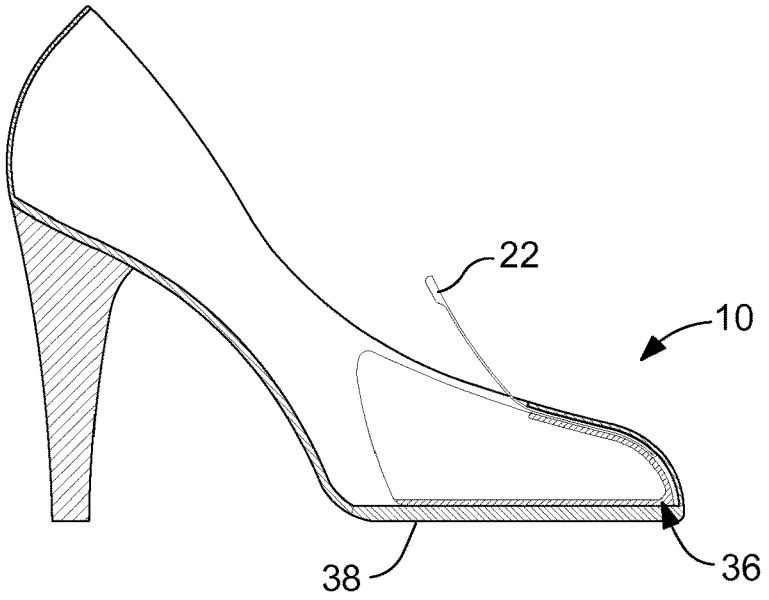
FIG. 4 illustrates a side cross-sectional side view taken along the line A-A of FIG. 2, in accordance with the first embodiment of the cushioning shoe insert, illustrating various features.
Figure 5:
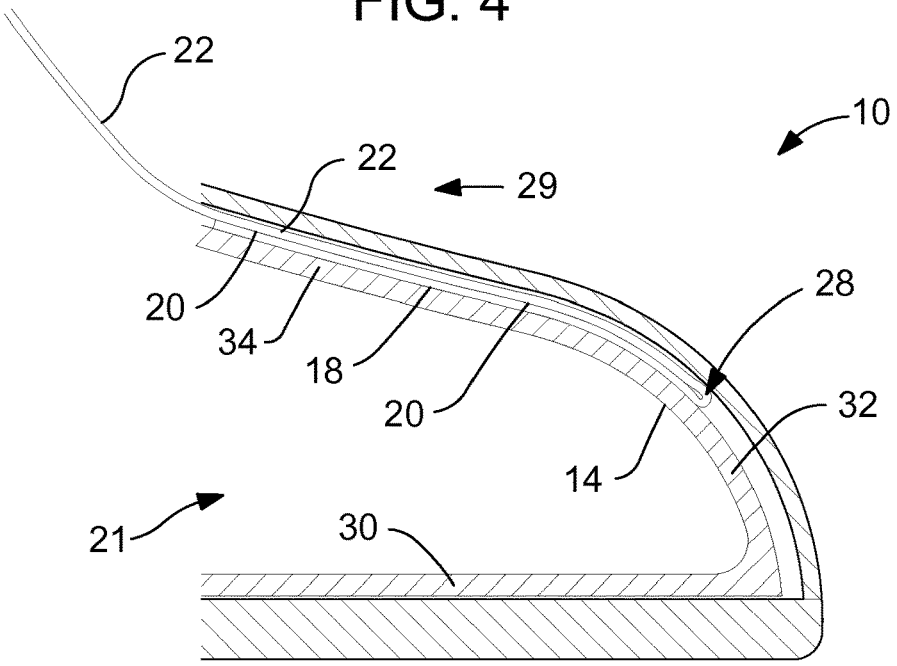
FIG. 5 illustrates an enlarged cross-sectional view taken along the line A-A of FIG. 2, in accordance with the first embodiment of the cushioning shoe insert, illustrating various features.

With particular reference to FIGS. 4-5, the side cross-sectional views taken along the line A-A of FIG. 2 illustrates various features of the cushioning shoe insert 10 and, more particularly, illustrates the preferred embodiment for attaching the tab(s) 22 to the flexible nonstick covers 20. As used herein, distal refers to further from the body and proximal refers to closer to the body. As can be seen, the tab(s) 22 attach to the flexible nonstick cover(s) 20 at generally the distal most region of the flexible nonstick cover 20. As the user pulls upon the tab 22, the flexible nonstick cover 20 is peeled off generally along a fold region 28 which moves generally in the direction of distal to proximal (as indicated by the arrow labeled 29 in FIG. 5) until the nonstick cover 20 is completely removed and can be discarded appropriately. As can be seen with particular clarity in FIG. 5, in some embodiments the tab 22 and flexible nonstick cover 20 features are comprised within a single material, e.g. a single sheet of peel off backing may be used to as accomplish both features. In such embodiments, the material may be folded such that a single continuous surface of the material comes into contact with itself thereby defining the boundary between the flexible nonstick cover 20, which is the portion of the peel off backing in contact with any portion of a layer of adhesive 18, and the tab 22. Suitable peel off backing materials will be sufficiently tear resistant to allow for the user to remove the material notwithstanding the material being essentially squeezed between the inner portion of the shoe and the pad 12. The suitable peel off backing materials will be one or more flexible sheets 23 which preferably comprise at least one release surface (not labeled in FIGS.). The release surface may comprise either silicone or polytetrafluoroethylene or any other suitable material, many of which are well known in many arts. As used herein, the term release surface intended to refer merely to the topology of the flexible sheet and is not to be interpreted as requiring discrete layer over the flexible sheet material. While in a preferred embodiment the flexible sheet 23 is coated with silicone, in other embodiments the material of the flexible sheet itself comprises sufficient topological characteristics to serve independently as the non-stick layer.

In preferred embodiments, the pad 12 includes at least a lower portion 30 for cushioning a plantar region of a foot, a front region 32 for cushioning a distal region of a foot; and an upper portion 34 for cushioning a dorsal region of a foot. Most preferably, the pad 12 additionally includes an inner portion 31 for cushioning a medial region of a foot and an outer portion 33 for cushioning a lateral portion of a foot. As used herein, medial means towards the center line of the body and lateral means away from the center line of the body. In some embodiments, the lower portion 30 extends generally from past a distal most portion 36 of a user's foot to slightly more proximal than a metatarsal region 38 of a user's foot and is intended to generally spread out vertical forces over the plantar region of a foot. In some embodiments, the front portion 32 generally fills in inner portion 21 of a shoe, wherein the inner portion 21 would otherwise be left generally void in the absence of the cushioning shoe insert 10. For example, typically when a woman wears pointed women's fashion shoes her toes do not fill the entire front inner portion 21 of the shoe which results in a relatively small area of the woman's foot coming into contact with the top line 44 of the shoe. Moreover, a typical women's fashion shoe includes a high heel 46 causing a steep slope 48 down which the user's foot tends to slide thereby causing the relatively small area of the woman's foot in contact with the top line 44 to experience high pressures which often result in blistering or bunions or both. With the inclusion of the front portion 32 the forces normally concentrated along the top line 44 are transferred, at least partially, to the portion of the user's foot contacting the inner surface 14 of the front portion 32. The upper portion 34 is preferable for similar reasons to the front portion 32 in that both reduce the amount of pressure concentrated along the top line 44.

Referring particularly to FIGS. 2-3, it can be seen here that although the pad 12 does not extend past the top line 44 of the shoe in the illustration the tabs 22 are sized such that a user would easily be capable of scribing the outer surface of the pad 12 adjacent to the top line 44 such that the pad 12 can be accurately customized for a specific shoe if such customization were needed, e.g. if the pad 12 extended past the top line 44 over the users foot. In some embodiments, the tabs 22 comprise an accordion like sequential fold structure allowing the entire tab 22 to be folded down flat without protruding out of the inner portion of the shoe 21 whilst a user scribes the outer surface of the pad 12. In other embodiments, including the one shown in FIGS. 1-5, a user may also simply fold the tab forward over the front or distal region of the foot as opposed to backward such that the tab does not block the user from scribing any portion of the outer surface of the pad.

Referring particularly to FIGS. 4-5, it can be seen that the upper portion 34 for cushioning a dorsal region of a foot is of generally constant thickness. However, in many embodiments the thickness of this portion will vary substantially. Preferably, the most distal part of the upper portion 34 will have a larger thickness than the more proximal part of the upper portion 34. Most preferably, the upper portion comprises a maximum thickness generally above the toes region which then tapers into a thinner constant thickness area over the top of the foot proximal of the toes. The constant thickness area is preferably between roughly 1-3 millimeters so that this area can be trimmed just distal from the top line 44 without created a visible gap between the upper foot and the top line 44.

Figure 6:
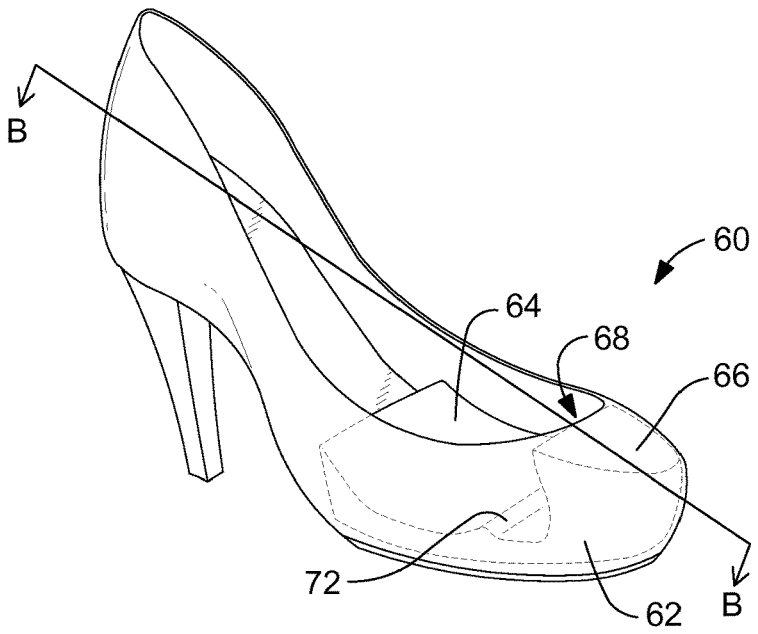
FIG. 6 illustrates a perspective view of a cushioning shoe insert, in accordance with a second embodiment of the present disclosure, wherein the cushioning shoe insert is inserted into a shoe.
Figure 7:
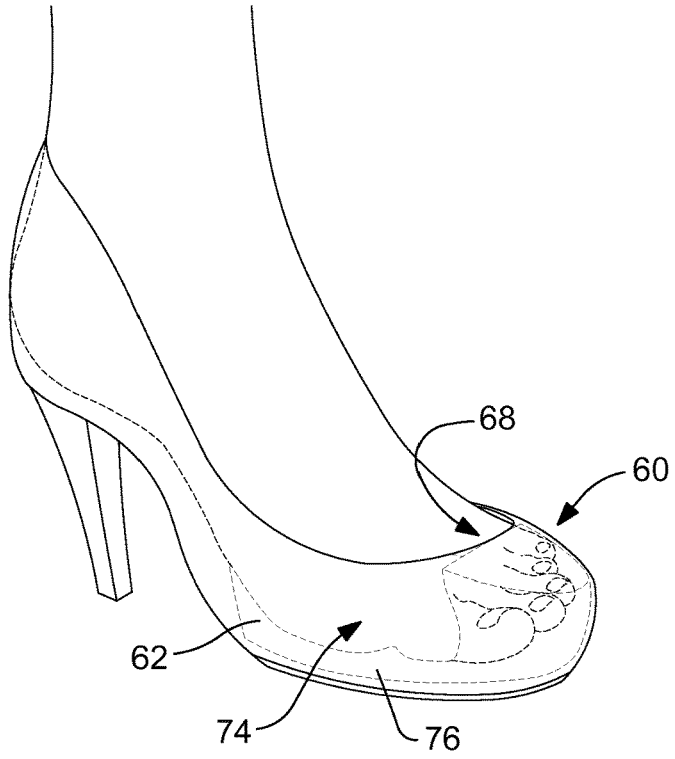
FIG. 7 illustrates a perspective view of the cushioning shoe insert, in accordance with the second embodiment, wherein a shoe wearer's foot is inserted into the cushioning shoe insert within a shoe.
Figure 8:
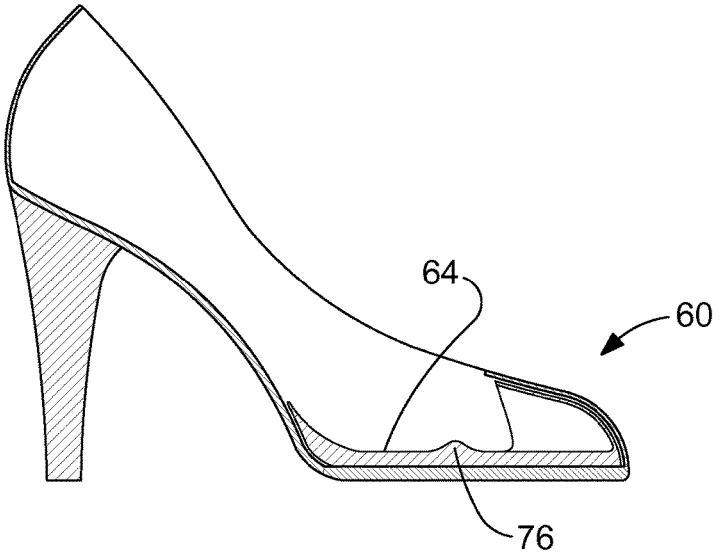
FIG. 8 illustrates a side cross-sectional side view taken along the line B-B of FIG. 6, in accordance with the second embodiment of the cushioning shoe insert, illustrating various features.

A second embodiment of the shoe insert 60 is illustrated in FIGS. 6-8. This embodiment comprises a pad 62 having an inner surface 64 configured for cushioning a foot and an outer surface 66 for attachment to an inner portion of a shoe 68. Moreover, this embodiment comprises one or more layers of adhesive (not shown) covered by one or more flexible nonstick covers (not shown) and a means (not shown) for removing the flexible nonstick cover while the pad 62 is compressed against the inner portion of the shoe 68. The means (not shown) may comprise a peel off backing material in accordance with the first embodiment. Alternatively, it may comprise a solution in which the nonstick cover is not folded but rather slides off of the adhesive when pulled upon.

The second illustrated embodiment, preferably, comprises a foot chock 76 which protrudes generally upwardly from the inner surface 64 and provides support to a metatarsal region of a foot. As used herein, metatarsal refers generally to the region of the foot below the metatarsal bones or just distal of the metatarsal bones. In the preferred embodiment, the foot chock 76 is located just forward of the metatarsal heads of the foot such that support is provided directly to the metatarsal heads from the foot chock 76 thereby reducing the pressure on the toe region of the foot at or near the opening of the shoe. The principle of the foot chock 76 is similar to that of the commonly known tire chock which is simply a wedge or block placed against a tire object to prevent it from moving. As shown in FIG. 7, the foot chock 76 may be configured to generally fill the volume 79 under the location where a user's toes meet the rest of the foot. Due to the already discussed problem of a shoe wearer's toes often being jammed into the inner portion of a shoe, it is easily recognizable that the foot chock 76, by supporting the foot at a location more proximal than the toes, will reduce the pressure and discomfort experienced by a shoe wearer. Especially when a type of shoe or activity causes the user's foot to be forced toward or into the front of the shoe, e.g. sliding down a high heel and being jammed into the front of the shoe.

Figure 9:
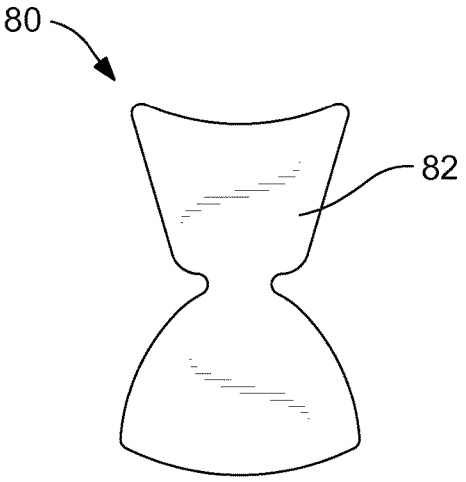
FIG. 9 illustrates a plan view of a cushioning shoe insert, in accordance with a third embodiment of the present disclosure, wherein the cushioning shoe insert is manufactured from a flat sheet of material.
Figure 10:
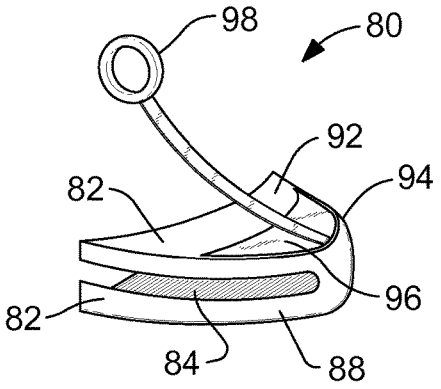
FIG. 10 illustrates a perspective view of the cushioning shoe insert, in accordance with the third embodiment, wherein the cushioning shoe insert is formed for insertion into a shoe.
Figure 11:
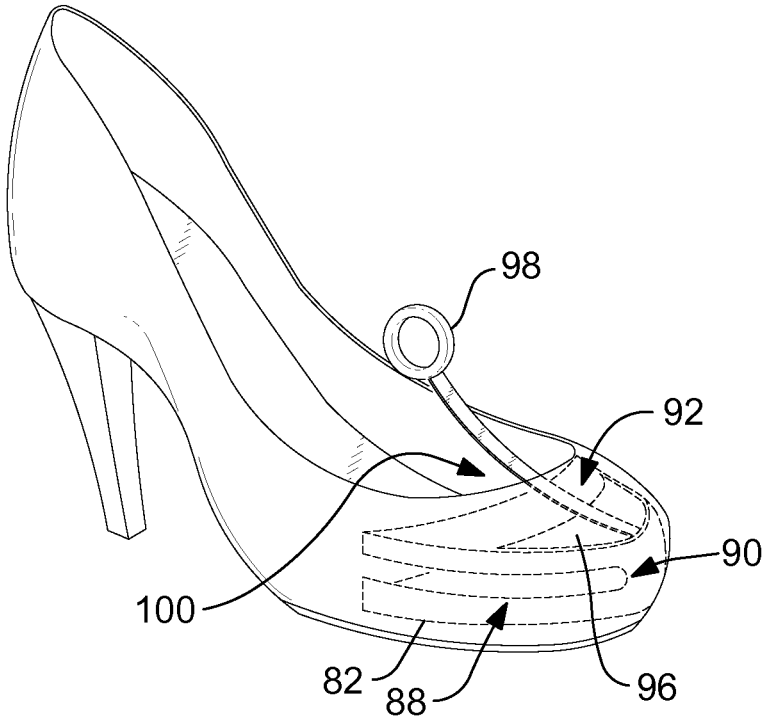
FIG. 11 illustrates a perspective view of the cushioning shoe insert, in accordance with the third embodiment, wherein the cushioning shoe insert is inserted into a shoe.

A third embodiment of the shoe insert 80 is illustrated in FIGS. 9-11. This embodiment comprises a pad 82 having an inner surface 84 and an outer surface 86. As illustrated, the pad 82 of this embodiment might not comprise an inner portion for cushioning a medial region of a foot and an outer portion for cushioning a lateral portion of a foot. There are at least two reasons why the shoe insert 80 might exclude an inner portion and an outer portion. First, this enables the shoe insert 80 to be constructed simply by cutting a shape out from a flat sheet of pad material and then fold the flat shape into a shoe insert shape 80 so as to create at least a lower portion 88 for cushioning a plantar region of a foot, a front portion 90 for cushioning a distal region of a foot; and an upper portion 92 for cushioning a dorsal region of a foot. FIG. 9 illustrates a "blank" of such a material having been cut out from a flat sheet of material. Second, because many shoes, and especially women's fashion shoes, have pointed toe regions and therefore narrow toe regions, it may be preferable to maximize space around the sides of the user's foot to decrease pressures. This third embodiment may also comprise one or more layers of adhesive 94 disposed over at least a portion of the outer surface 86 of the shoe inset 80, the adhesive 94 being covered by a nonstick cover 96. As in other embodiment, the nonstick cover 96 is easily removed by pulling upon a tab 98. The nonstick cover may be exposed while the shoe insert is within an inner portion of a shoe 100 with or without a user's foot.

While preferred and alternate embodiments have been illustrated and described, as noted above, many changes can be made without departing from the spirit and scope of the cushioning shoe insert. Accordingly, the scope of the cushioning shoe insert is not limited by the disclosure of these preferred and alternate embodiments. Instead, the scope of the cushioning shoe insert should be determined entirely by reference to the claims.

What is claimed is:

1. A shoe insert comprising: a pad comprising:

one or more inner surfaces for cushioning a foot of a user, wherein at least one of the one or more inner surfaces defines an upper portion for cushioning a dorsal region of the foot;

one or more outer surfaces to interface with an inner portion of a shoe; and a lower portion comprising a foot chock protruding upwardly from the one or more inner surfaces between a metatarsal region of the foot and a toe region of the foot, the foot chock to provide support to the metatarsal region of the foot and reduce pressure on the toe region of the foot;

a layer of adhesive disposed over at least a portion of an upper outer surface of the one or more outer surfaces of the pad;

a flexible nonstick cover disposed over the layer of adhesive; wherein said flexible nonstick cover comprising a pull tab with a first end extending from the inner portion of the shoe and a second end folded into contact with the flexible nonstick cover such that said first end configured to pull to form a fold region with the flexible nonstick cover in the inner portion of the shoe, wherein the pull tab is configured to remove the flexible nonstick cover to expose the layer of adhesive while the one or more outer surfaces of the pad interfaces with the inner portion of the shoe.

2. The shoe insert of claim 1, wherein the pad further comprises one or more of: at least one layer of low-resilience polyurethane; at least one layer of nonwoven fabric; at least one antimicrobial agent; or any combination thereof.

3. The shoe insert of claim 1, wherein the pad further comprises at least one of: a lower portion for cushioning a plantar region of a foot; a front region for cushioning a distal region of a foot; or any combination thereof.

4. The shoe insert of claim 3, wherein the pad is made by a process comprising the step of: removing a predetermined shape from a generally flat material, wherein the predetermined shape defines an outer perimeter of the pad.

5. The shoe insert of claim 1, wherein the flexible nonstick cover includes at least one release surface, the at least one release surface including at least one of silicone or polytetrafluoroethylene.

6. The shoe insert of claim 1, wherein the pull tab further comprises an accordion like sequential fold structure to allow the pull tab to be folded down flat an outer surface of the shoe to enable a user to scribe a portion of the one or more outer surfaces of the pad.

7. A shoe insert comprising: a pad having one or more inner surfaces for cushioning a foot of a user and one or more outer surfaces to interface with an inner portion of a shoe, the one or more inner surfaces of the pad comprising a foot chock protruding upwardly from the one or more inner surfaces to provide support to an area between a metatarsal head of the foot and a toe region of the foot, the foot chock configured to reduce pressure on the toe region of the foot;

a layer of adhesive disposed over an upper outer surface of the one or more outer surfaces of the pad;

a flexible nonstick cover disposed over the layer of adhesive; wherein said flexible nonstick cover a pull tab with a first end extending from the inner portion of the shoe and a second end folded into contact with the flexible nonstick cover such that said first end configure to pull to create a fold region with the layer of adhesive, wherein the pull tab is configured to remove the flexible nonstick cover to expose the layer of adhesive while the one or more outer surfaces of the pad interfaces with the inner portion of the shoe.

8. The shoe insert of claim 7, wherein the pad further comprises a generally triangular shaped front portion configured for insertion into a generally pointed toe region of the shoe for transferring pressure from the inner portion of the shoe to the foot.

9. The shoe insert of claim 7, further comprising a nonslip surface over at least a portion of one or more of: the one or more inner surfaces; the one or more outer surfaces; or both.

10. The shoe insert of claim 9, wherein the one or more inner surfaces comprise the nonslip surface and wherein the nonslip surface comprises one or more of: at least one bump; at least one indentation; or any combination thereof.

11. The shoe insert of claim 7, wherein the fold region advances in a proximal direction from a first end of the layer of adhesive to a second end of the layer of adhesive.

* * * * *